US006264085B1

(12) United States Patent
Ho et al.

(10) Patent No.: US 6,264,085 B1
(45) Date of Patent: Jul. 24, 2001

(54) SAFETY DEVICE FOR A PNEUMATIC STAPLER TO AVOID SHOOTING AFTER THE MAGAZINE BEING REMOVED FROM THE BARREL

(75) Inventors: Roman Ho; Jack Chen; Hsuan-Chin Chiang, all of Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 09/756,600

(22) Filed: Jan. 8, 2001

(51) Int. Cl.[7] ..... B25C 1/04
(52) U.S. Cl. ..... 227/8; 227/120
(58) Field of Search ..... 227/8, 120, 119; 221/227, 279, 238

(56) References Cited

U.S. PATENT DOCUMENTS 5,322,189 * 6/1994 Oda ..... 227/120
5,579,975 * 12/1996 Moorman ..... 227/8
6,012,622 * 1/2000 Weinger et al. ..... 227/8
6,145,724 * 11/2000 Shkolnikov et al. ..... 227/8
6,199,739 * 3/2001 Mukoyama et al. ..... 227/120
6,209,770 * 4/2001 Perra ..... 227/8

* cited by examiner

*Primary Examiner*—Scott A. Smith
(74) *Attorney, Agent, or Firm*—Charles E. Baxley

(57) ABSTRACT

A safety device for a pneumatic stapler includes a safety member rotatably mounted to a barrel of the stapler by a torsion spring located between the safety member and the barrel. The safety member has a first protrusion and a second protrusion. The first protrusion is pushed by a magazine connected to the barrel and the second protrusion is located at a higher position to allow a safety plate to be moved between the two protrusions. When the magazine is removed and the second protrusion is rotated to a lower position, the safety plate is stopped by the second protrusion.

3 Claims, 3 Drawing Sheets

SAFETY DEVICE FOR A PNEUMATIC STAPLER TO AVOID SHOOTING AFTER THE MAGAZINE BEING REMOVED FROM THE BARREL

FIELD OF THE INVENTION

The present invention relates to a safety device for preventing from shooting of a pneumatic stapler when the magazine is removed from the barrel.

BACKGROUND OF THE INVENTION

A conventional pneumatic stapler employs powerful pneumatic machine to eject a staple to penetrate an object. In order to ensure a safety operation when using the pneumatic stapler, a safety plate is equipped in each of the conventional pneumatic staplers so that then trigger can only be pulled when the safety plate is unlocked. However, there is a dangerous situation that the pneumatic stapler could be unintentionally triggered to hurt people, that is when the magazine is removed from the barrel of the pneumatic stapler. This happens when the staples are jammed in the barrel and the user wants to withdraw the shooting problem so that he/she removes the magazine from the barrel and checks or removes the jammed staples. During the checking or removal of the jammed staples, the trigger could be pulled unintentionally and a staple ejects out from the barrel and hurts people.

The present invention intends to provide a safety device that is rotated when the magazine is removed and stops the safety plate from moving so as to avoid the trigger from being pulled.

SUMMARY OF THE INVENTION

In accordance with one aspect of the present invention, there is provided a safety device for a pneumatic stapler and comprising a barrel having a slot and threaded hole respectively defined therein. A safety member has a connection hole and a first protrusion and a second protrusion respectively extend from the safety member. A boss extends from a surface of the safety member and is movably retained in the slot. A torsion spring is connected between the barrel and the safety member. A bolt extends through the connection hole of the safety member and the torsion spring and is engaged with the threaded hole in the barrel. The first protrusion is pushed upward by a magazine.

The primary object of the present invention is to provide a safety device that stops the safety plate from being unlocked when the magazine is removed.

These and further objects, features and advantages of the present invention will become more obvious from the following description when taken in connection with the accompanying drawings which show, for purposes of illustration only, several embodiments in accordance with the present invention.

DETAILED DESCRIPTION OF THE EMBODIMENT

Figure 1:
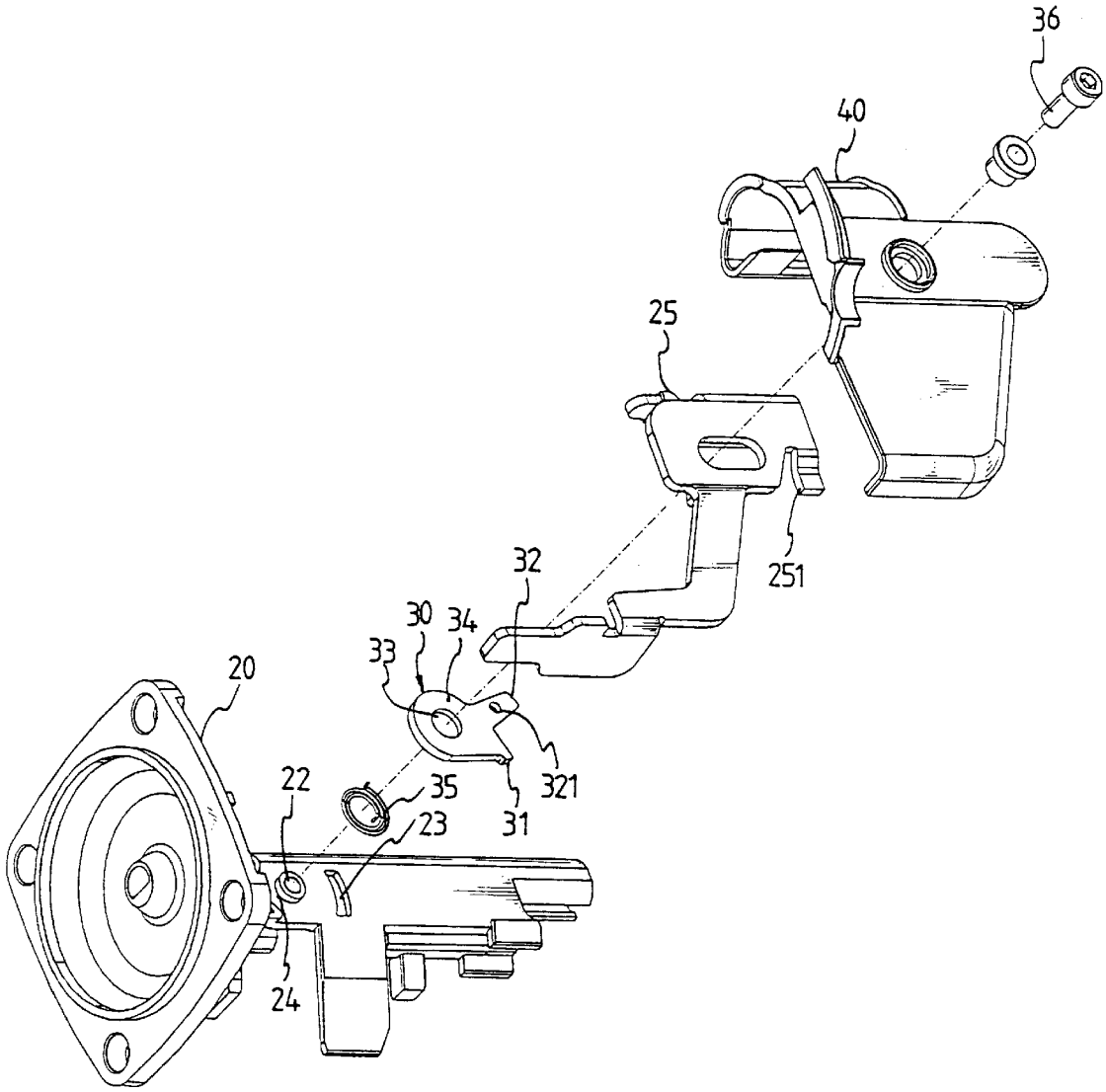
FIG. 1 is an exploded view to show a safety device for a pneumatic stapler of the present invention.
Figure 2:
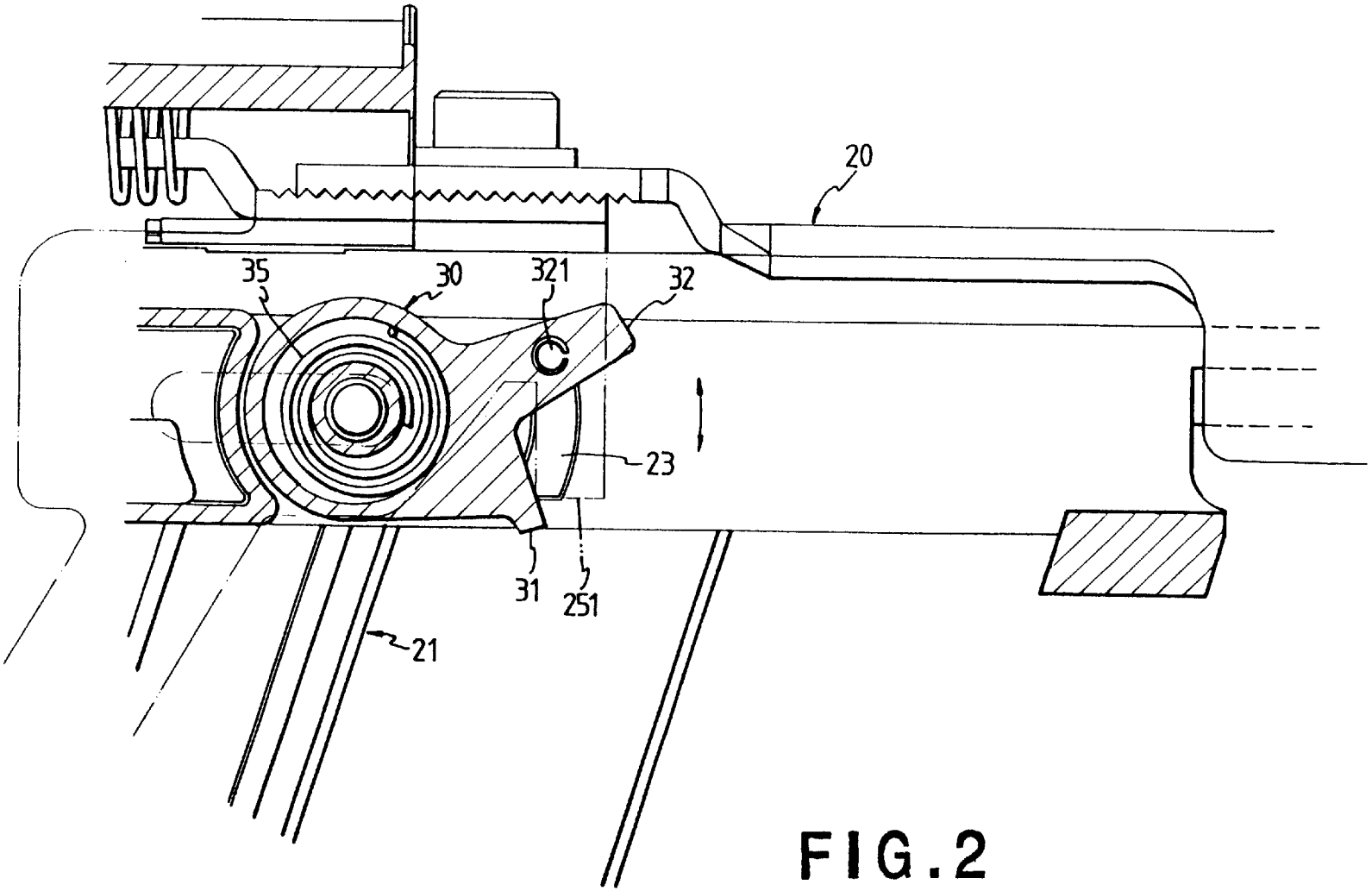
FIG. 2 is a side view to show that the safety member is rotated counter clockwise by a magazine connected to a barrel of the stapler.

Referring to FIGS. 1 and 2, the pneumatic stapler of the present invention comprises a barrel 20 which has a slot 23 and threaded hole 22 respectively defined therein, and a first aperture 24 is defined in the barrel 20 and located beside the threaded hole 22. A safety member 30 is mounted to the barrel 20 and has a connection hole 33 and a second aperture 34 defined in the safety member 30. A first protrusion 31 and a second protrusion 32 respectively extend from the safety member 30. A boss 321 extends from a surface of the safety member 30 and is movably retained in the slot 23 in the barrel 20.

A torsion spring 35 is connected between the barrel 20 and one end of the torsion spring 35 is engaged with the first aperture 24 in the barrel 20 and the other end of the torsion spring 35 is engaged with the second aperture 34 in the safety member 30. A bolt 36 extends through the connection hole 33 of the safety member 30 and the torsion spring 35 and is engaged with the threaded hole 22 in the barrel 20. A safety plate 25 is slidably mounted to the barrel 20 and an end of the safety plate 25 and a dust cover 40 is mounted to the barrel 20 and covers the safety member 30 and the safety plate 25. As shown in FIG. 2, when a magazine 21 is connected to the barrel 20, the top end of the magazine 21 pushes the first protrusion 31 upward and the safety member 30 is then rotated counter clockwise and the second protrusion 32 is rotated to a higher position. At this position, a tongue 251 of the safety 25 can be moved between the first protrusion 31 and the second protrusion 32 and the trigger can be pulled.

Figure 3:
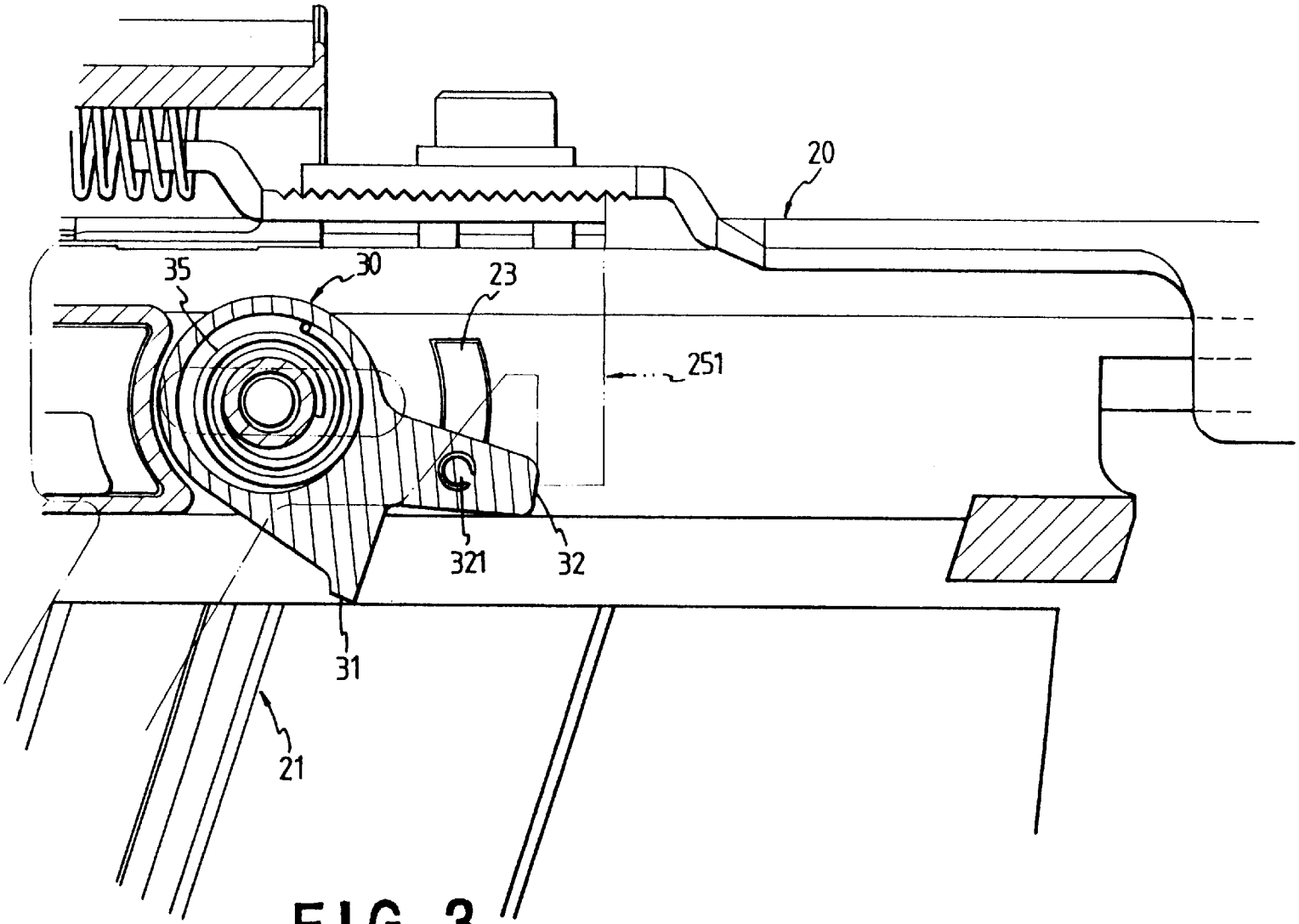
FIG. 3 is a side view to show that the safety member is rotated clockwise when a magazine is removed from the barrel of the stapler.

As shown in FIG. 3, when removing the magazine 21 from the barrel 20, the safety member 30 is rotated clockwise by the torsion spring 35 and the second protrusion 32 is lowered so that the tongue 251 of the safety plate 25 is stopped by the second protrusion 32 and the trigger cannot be pulled.

By using the safety member 30, the safety plate 25 cannot be moved to a ready-for-shoot position if the magazine 21 is removed from the barrel 20 so that when the trigger is automatically locked when the magazine 21 is removed from the barrel 20.

While we have shown and described various embodiments in accordance with the present invention, it should be clear to those skilled in the art that further embodiments may be made without departing from the scope and spirit of the present invention.

What is claimed is:

1. A safety device for a pneumatic stapler, comprising:

a barrel having a slot and threaded hole respectively defined therein;

a safety member having a connection hole, a first protrusion and a second protrusion respectively extending from said safety member, a boss extending from a surface of said safety member, and a torsion spring connected between said barrel and said safety member, said boss movably retained in said slot in said barrel, a bolt extending through said connection hole of said safety member and said torsion spring and being engaged with said threaded hole in said barrel, said first protrusion adapted to be pushed by a magazine.

2. The safety device as claimed in claim 1, wherein said boss extending from a surface of said second protrusion.

3. The safety device as claimed in claim 1 further comprising a first aperture defined in said barrel and located beside said threaded hole, a second aperture defined in said safety member, one end of said torsion spring engaged with said first aperture in said barrel and the other end of said torsion spring engaged with said second aperture in said safety member.

* * * * *